US005156196A

United States Patent [19]

Corey et al.

[11] Patent Number: 5,156,196

[45] Date of Patent: Oct. 20, 1992

[54] SHADE POSITIONING AND MOUNTING APPARATUS

[75] Inventors: John Corey, Melrose; John Schnebly, Wynanpskill, both of N.Y.

[73] Assignee: Comfortex Corporation, Cohoes, N.Y.

[21] Appl. No.: 638,309

[22] Filed: Jan. 7, 1991

[51] Int. Cl.[5] ..... C06B 9/324

[52] U.S. Cl. ..... 160/178.2; 160/168.1

[58] Field of Search ..... 160/178.2, 168.1; 24/134 R, 134 KA

[56] References Cited

U.S. PATENT DOCUMENTS

| | | | |
|---|---|---|---|
| 2,129,606 | 9/1938 | Nisenson | 160/178.2 X |
| 2,357,911 | 9/1944 | Schaefer | 160/178.2 X |
| 3,294,153 | 12/1966 | Fountain | 160/178.2 X |
| 4,646,808 | 3/1987 | Anderson | 160/178.2 |
| 4,651,795 | 3/1987 | Valle et al. | 160/178.2 |
| 4,719,956 | 1/1988 | Valle | 160/178.2 |
| 4,813,468 | 3/1989 | Fraser | 160/168.1 X |
| 4,955,420 | 9/1990 | Marinescu et al. | 160/178.2 |

*Primary Examiner*—Carl D. Friedman
*Assistant Examiner*—Derek J. Berger
*Attorney, Agent, or Firm*—Dykema Gossett

[57] ABSTRACT

A shade positioning and mounting apparatus 10 is disclosed which allows a shade 12 to be raised or lowered to a desired position by means of a cord 80 under the control of a cam 22. The cord lock body 20 is symmetrically configured about a longitudinal axis so that the same body can be interchangeably used at either end of the top shade rail 14. Mounting bracket 16 permits shade rail 14 to be readily secured to or released from a supporting wall or ceiling by means of a manually operable locking member 50 which slides between the locked and released positions without the need for any tools.

8 Claims, 4 Drawing Sheets

SHADE POSITIONING AND MOUNTING APPARATUS

FIELD OF THE INVENTION

This invention relates to a shade positioning and mounting apparatus including a positioning apparatus effective to raise or lower a shade to a desired position and a mounting bracket effective to mount a shade to a ceiling or a wall.

DISCUSSION

Shades are used in a wide variety of applications to regulate the amount of light entering a given location and to enhance the overall appearance of the location in which the shades are placed. These shades normally employ several strings which are vertically placed through the shade and are bundled into a single shade cord. The shade cord is used to raise or lower the shade in conjunction with some sort of shade positioning apparatus.

While these past shade positioning apparatuses allow for the desired positioning of the shades, they suffer from many drawbacks. That is, many of these positioning apparatuses are relatively complex, relatively costly and are prone to failure. Many of these past shade positioning apparatus also cause damage to the shade cord during operation and require relatively costly and complex modifications when the shade positioning apparatus is repositioned, or moved from one side of the shade to the other. These complex modifications are required because many of these past shade positioning apparatuses have been designed to operate only when positioned on a designated side of the shade. Should a shade owner desire to modify the surrounding area or place the shade in a new area requiring that the existing shade positioning apparatus be repositioned relative to the shade, a new positioning apparatus is required to be built or extensive modifications need to be accomplished. Also, many of these past shade apparatuses are relatively bulky in appearance and detract from the pleasant overall appearance of the shade itself. Additionally, many of these past shade positioning apparatuses frequently tangle or otherwise twist the shade cord after continued use of the apparatus, thereby preventing the desired positioning of the shade and causing the expenditure of a great deal of time and effort in needed repositioning of the cord.

Mounting brackets have also been utilized in conjunction with shades in order to mount the shades and more particularly are used to mount the shade rail to a ceiling or a wall. These brackets suffer from many drawbacks in that many of these brackets include a movable screw which must be tightened in order to securely mount the bracket to the shade rail. The tightening of the screw requires the rotation of a screw driver behind and parallel to the shades thereby requiring much time and effort on the part of an installer and oftentimes resulting in the complete detachment of the shades and rail from the mounting bracket itself. Many of these brackets further utilize a separate member which is placed in varying contact with the rail as the screw is tightened. This separate member adds to both the complexity and the cost of these brackets and fails to alert the installer that the screw has been sufficiently tightened in order that the rail and/or bracket may not become damaged due to overtightening. Attempts have been made to overcome these aforementioned drawbacks by the use of a bracket having a flexible body which may be compressibly fitted and secured within the rail. This bracket, though relatively simple in design, is relatively difficult to compress and/or remove and does not readily slide along the rail to an exact desired position.

Many of these past mounting brackets also have mounting screw openings, each of which is designed to receive a screw, such that the screw is horizontally mounted to a wall. However, these screws have usually been angularly mounted to the wall such that only the bottom of the screw head contacts the mounting bracket thereby allowing the loosening of the bracket from the wall due to the forces of the suspended shade.

Many of these past mounting brackets further have a rather thick top portion which overlays and rests within the shade rail. While such thickness strengthens the bracket, its outward protrusion from the top of the rail detracts from the appearance of the shade installation while setting the shade away from the shaded window thereby leaving an unshaded portion above the top of the shade.

It is therefore a primary object of this invention to provide a shade positioning apparatus which is operable when used on either side of the shade.

It is another object of this invention to provide a shade positioning apparatus which is compact, simple and pleasing in design.

It is another object of this invention to provide a shade positioning apparatus which substantially prevents the shade cord from becoming twisted or worn from extended use.

It is yet a further object of this invention to provide a mounting bracket which is simple in design and appearance and which normally lies substantially over and flush against the top of the shade rail.

It is another object of this invention to provide a mounting bracket which may be easily inserted within or removed from a shade rail.

It is a further object of this invention to provide a mounting bracket which can be secured to a shade rail without the use of a separate screw.

It is another object of this invention to provide a mounting bracket having screw reception openings which allow mounting screws to be obliquely inserted into the wall.

SUMMARY OF THE INVENTION

According to one aspect of the invention, a shade positioning apparatus is provided which includes a cord positioning means adapted to operate on any one of the two ends of the head rail, and cord guide means for receiving the shade cord and for guiding the shade cord to said cord positioning means.

According to a second aspect of this invention, a shade rail mounting bracket is provided for use with a rail having first and second flange reception members and which includes a planar portion substantially overlaying one surface of the rail and having first and second flange members which are respectively movably nested within the first and second flange reception members; and bias member means, slidably disposed within the bracket, for movement between an open position in which the first and second flange members continue to be movably nested within the respective first and second flange reception members and a closed position in which the second flange member is forced against the second flange reception member effective to fixably position both the first and the second flange members within the respective first and second flange reception members, thereby firmly securing the bracket to the rail.

Further objects, features, and advantages of the invention will become apparent from the consideration of the following description and the appended claims when taken in conjunction with the accompanying drawings.

DETAILED DESCRIPTION OF THE INVENTION

Figures 1, 2:
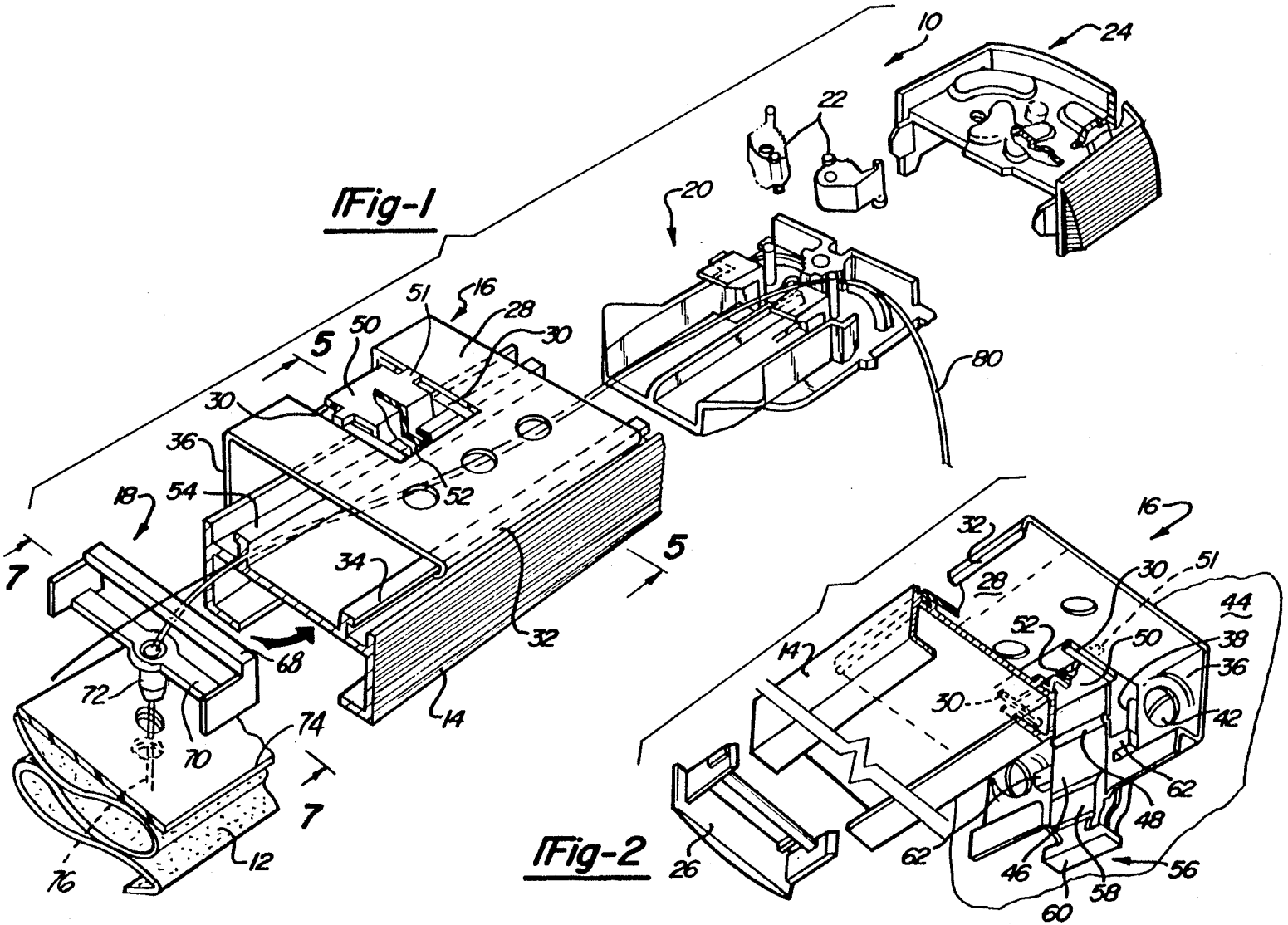
FIG. 1 is an exploded perspective view of the shade positioning and mounting apparatus of this invention.
FIG. 2 is a partially sectioned perspective view illustrating the mounting apparatus of this invention in assembled relation with a typical shade head rail.
Figure 3:
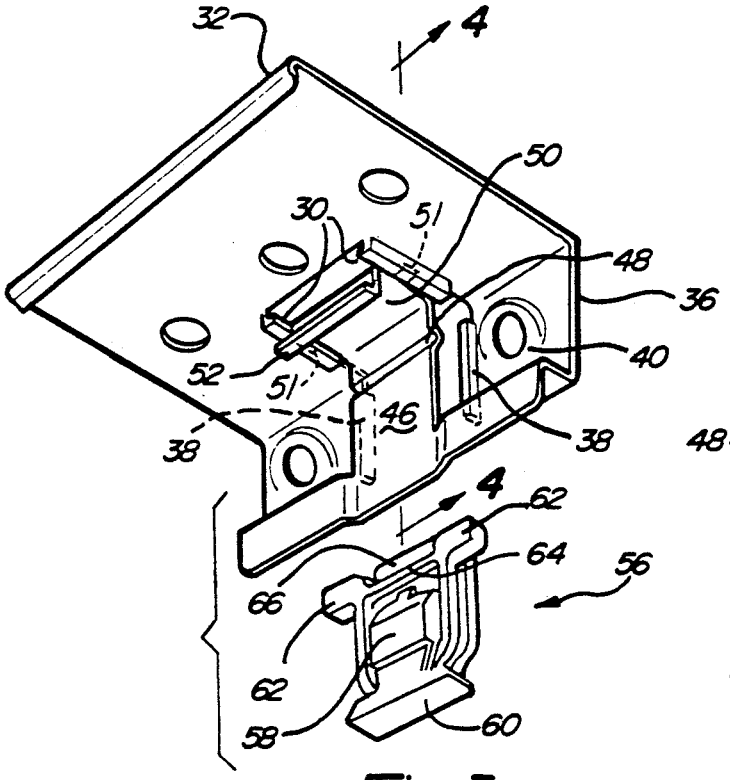
FIG. 3 is an exploded perspective view of the shade mounting apparatus of this invention.

Referring now to FIGS. 1 and 2, there is shown the shade positioning and mounting apparatus 10 of the preferred embodiment of this invention, in assembled relation with a typical shade 12 and a typical shade head rail 14. As shown, apparatus 10 comprises a rail mounting bracket 16, a cord guide 18, a cord positioning apparatus 20 (including cams 22), a top cap 24, and an end cap 26.

As best shown in FIGS. 1, 2, 3 and 5, bracket 16 includes a relatively thin top planar portion 28 having downwardly extending "L"-shaped tracks 30 formed therein and a rounded end 32 which is normally received by the "L"-shaped flange reception member 34 of the rail 14 and which allows portion 28 to movably overlay the top surface of the rail 14. Bracket 16 further includes a sidewall 36 having outwardly extending ribs 38 and angled openings 40, which receive mounting screws 42 (FIG. 2) and which obliquely (with respect to the surface of wall 44) direct screws 42 into the wall 44 thereby reducing the tendency of the bracket 16 to be later loosened from the wall 44 by the weight of shade 12. Sidewall 36 further includes a biasing member 46 having an outwardly protruding saddle portion 48 and a free end 50. End 50 has laterally projecting tabs 51, which are movably disposed within tracks 30, and further has an outwardly extending flange 52 normally received by a second "L"-shaped flange reception member 54 and to cause rail 14 to be securely mounted to bracket 16 in a manner that will be explained. Biasing member 46 is normally in the dotted position shown in FIG. 4 except when cammed to the right for locking, as will be explained. The reception of flanges 32 and 52 by flange reception members 34 and 54 respectively, also allows relatively thin portion 28 to lie substantially flush against the top surface of rail 14, thereby providing a compact and aesthetic overall appearance.

As best shown in FIGS. 2 through 6, bracket 16 further includes a locking member 56 which is vertically slidable along biasing member 46. Member 56 includes a tongue 58 resiliently projecting from base 60 and a pair of tabs 62 extending laterally from a camming edge 64. Tongue 58 slides along one face of biasing member 46, while tabs 62 ride in the space between the opposite face of biasing member 46 and ribs 38. The resilience of tongue 58 causes locking member 56 to frictionally grip biasing member 46 as it slides therealong. Further, member 56 when in the locked position of FIG. 5, prevents the rail 14 from deflecting away from the shades (i.e., "rearwardly") in response to downward forces acting thereon (i.e. caused by the tension in cord 80).

Figure 4:
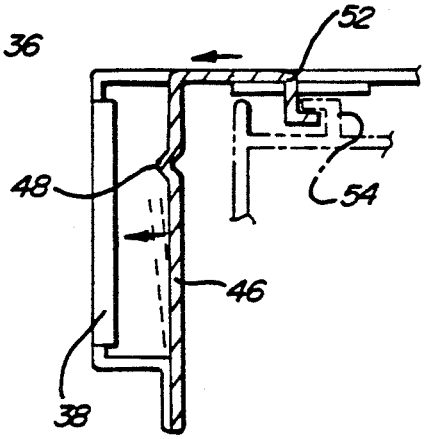
FIG 4 is a partial sectional view of the mounting apparatus of this invention taken along line 4—4 of FIG. 3.
Figure 5:
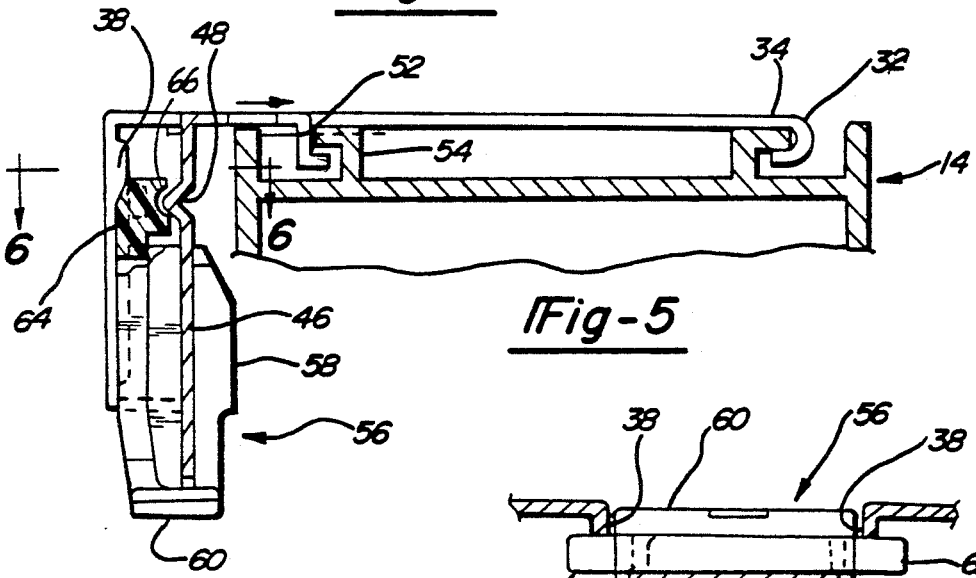
FIG. 5 is a partial sectional view of the mounting apparatus of this invention taken along line 5—5 of FIG. 1.
Figure 6:
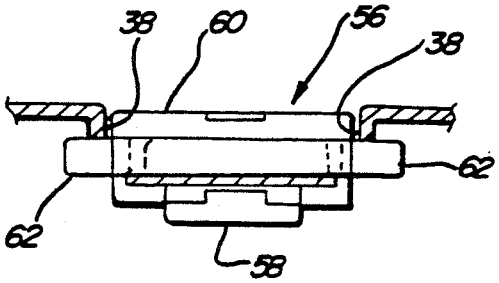
FIG. 6 is a partial sectional view of the mounting apparatus of this invention taken along line 6—6 of FIG. 5.

Comparing the unlocked condition of FIG. 2 with the locked condition of FIG. 5, in FIG. 2 camming edge 64 is below the level of saddle 48 and therefore is ineffective to displace biasing member 46 from its unlocked position shown in dotted lines in FIG. 4. However, when locking member 56 is moved upwardly to the locked condition of FIG. 5, camming edge 64 engages saddle 48 and cams it and biasing member 46 to the right. This movement causes flange 52 to be forced against flange 54 thereby locking flange 32 to flange 34, which locks rail 14 to bracket 16. Groove 66 on member 56 cooperates with saddle 48 in this locked position to act as a detent to normally retain the assembly in this locked condition until locking member is pulled downwardly to disengage edge 64 from saddle 48.

Locking member 56 therefore allows rail 14 to be readily secured or removed from bracket 16 without the need for any tools or time-consuming procedure.

Figure 7:
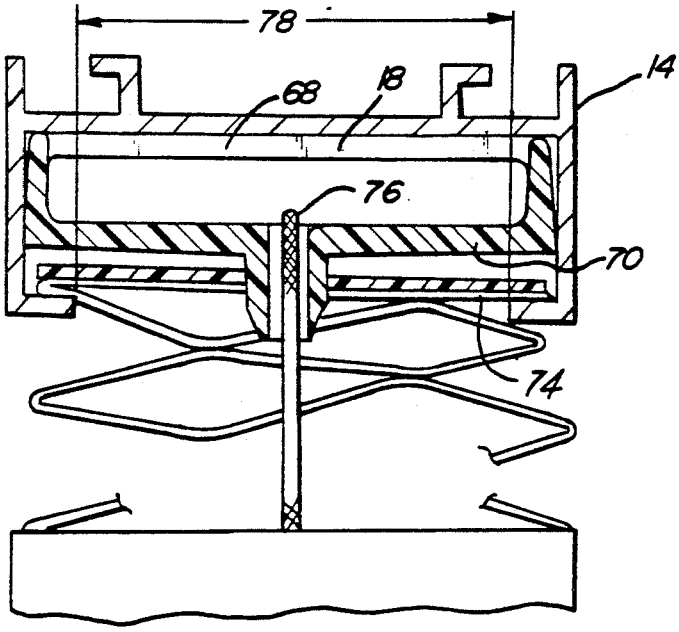
FIG. 7 is a sectional view of a cord guide made in accordance with the teachings of this invention and taken along line 7—7 of FIG. 1.

Referring now to FIG. 1 and 2, cord guide 18 is seen as including an upper guide 68 and a lower guide 70 having a bushing 72 which is normally frictionally inserted into a stiffener member 74 of shade 12 and which also receives a typical shade string 76. In the preferred embodiment of this invention, several cord guides 18 are disposed within head rail 14 and are installed along the length of the shade 12 such that every bushing 72 receives a separate and unique string 76. The stiffener member 74 may comprise a relatively thin metal strip which is inserted into the topmost pleat of the shade 12, or it may alternatively comprise a thin plastic strip which is glued to the top of the topmost pleat (i.e., the pleat closest to rail 14) of the shade 12. In either case, stiffener member 74 must be wider than the opening 78 of rail 14 (see FIG 7) in order that shade 12 remain secured to rail 14.

As the strings 76 run through the length of head rail 14, they are routed between guides 68 and 70 of every cord guide 18 that is positioned between their respective reception bushing 72 and the end of the head rail 14 from which all of the strings 76 exit. In this manner, the cord guides 18, deployed within head rail 14, allow the strings 76 to move through the head rail 14 without binding or tangling. The bushings 72 provide a smooth path for the strings 76 to move through stiffener member 74 without fraying or being damaged. The exiting strings are bundled into a single shade cord 80.

Figure 8:
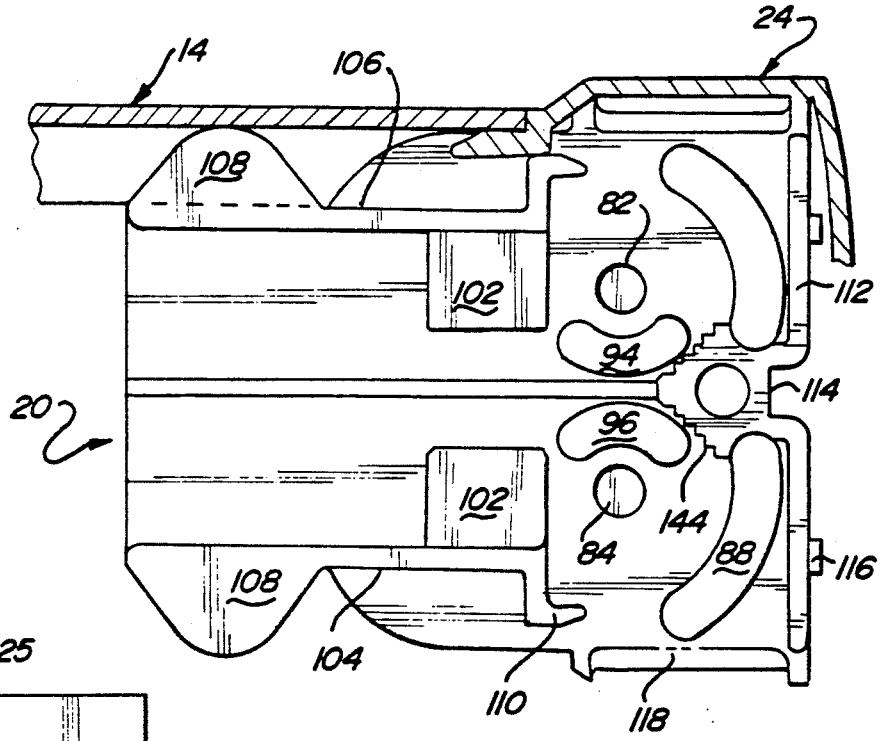
FIG. 8 is a partial plan view illustrating the shade positioning apparatus of this invention in assembled relation with a typical head rail.
Figure 9:
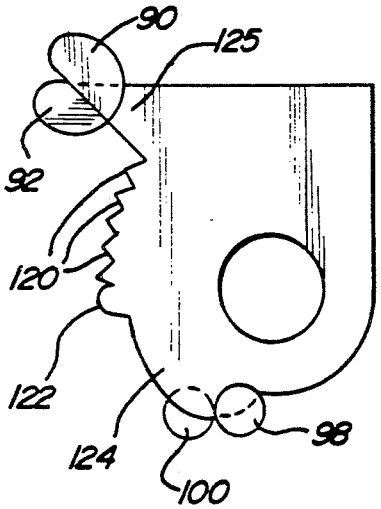
FIG. 9 is a plan view of the cam of this invention.

Referring now to FIGS. 1 and 8, cord positioning apparatus 20 comprises pivot posts 82 and 84 upon which cams 22 pivot; arcuate depressions 86 and 88 which respectively receive tabs 90 and 92 of cam 22 (FIG. 9); and arcuate depressions 94 and 96 which respectively receive tabs 98 and 100 of cam 22 (FIG. 9). As is evident from FIG. 8, the posts 82 and 84 and arcuate depressions 86, 88, 94 and 96 are symmetrically placed and dimensioned so that cam 22 may be pivotally placed on either post 82 or 84 depending on which end of head rail 14 is to receive cord lock device 20.

Apparatus 20 further includes depressible "L-shaped" tabs 102 and sidewalls 104 and 106, each respectively having a raised and outwardly extending triangular flange 108 on one end thereof and an "L-shaped" flange 110 on the opposite end. As apparatus 20 is inserted into head rail 14, flanges 108 engage opposite interior sides of the head rail 14 while each of the tabs 102 snap over the top surface of the head rail 14. In this manner, device 20 is securely coupled within the head rail 14.

Figure 10:
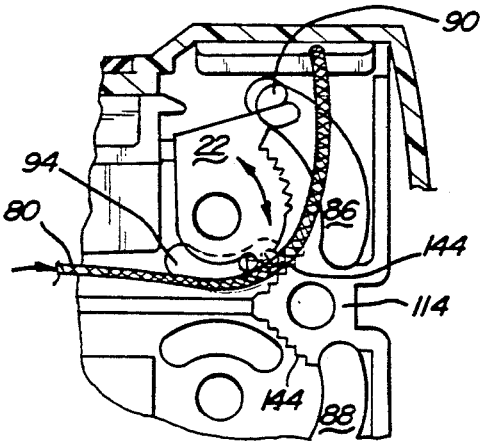
FIG. 10 is a partial plan view of the shade positioning apparatus of this invention showing a right handed application.
Figure 11:
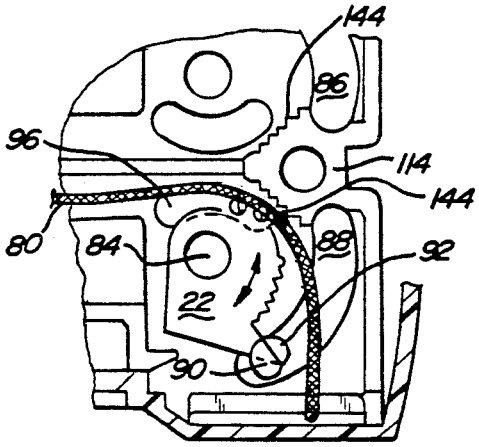
FIG. 11 is a partial plan view of the shade positioning apparatus of this invention showing a left handed application.

Apparatus 20 further includes a backwall 112 having a fixed serrated clamping member 114, spacer 116, and smooth beveled cord indentation ramps 118 over which the cord 80 may pass as it is raised or lowered. Cam 22 may be pivotally mounted on either post 82 or 84 either after the device 20 is coupled to the head rail 14, or before such coupling. After cam 22 is placed within device 20, cord 84 is threaded between cam 22 and serrated member 114 and then passed over one of the ramps 118. Cord 80 substantially always maintains contact with cam 22 and imparts various forces thereto as will be described below. The selection of post 82 or 84 depends upon which end of the shade the user desires for deployment of cord 80. That is, if cord 80 is to be on the right end of head rail 14 when facing the wall, then cam 22 is mounted on post 84 (FIG. 11). For left end mounting cam 22 is mounted on post 82 (FIG. 10).

The placement of tabs 90, 92, 98, and 100 into respective depressions 86, 88, 94, and 96 accommodates pivotal movement of cam 22 in response to the forces exerted thereon by cord 80, and substantially prevents cord 80 from going above and/or beneath cam 22, when used in combination with top cap 24, as will be discussed. The clamping or release of cord 80 is determined by the position of cam 22 relative to clamping member 114, which in turn is defined by the force of cord 80 on cam 22 and the geometric structure of the cam 22 itself. These forces will be discussed below.

As shown best in FIG. 9, cam 22 has a series of substantially identical serrations 120 along one edge thereof; a rounded tooth 122, positioned on one side of the serrations 120; a smooth cord engaging surface 124 adjacent to tooth 122; and a "V-shaped" clamping tip 125. When the cord 80 is threaded through apparatus 20 (FIGS. 10 and 11), it is made to contact surface 124 and such contact is always maintained.

To understand how the movement of the cord 80 causes the cam 22 to pivot within device 20, reference is made to FIGS. 12–18 which show the forces upon cam 22 when placed in a right hand application. It should be realized, by one of ordinary skill in the art, that the following discussion is equally applicable to a cam 22 placed in a left handed configuration (FIG. 10).

Figure 12:
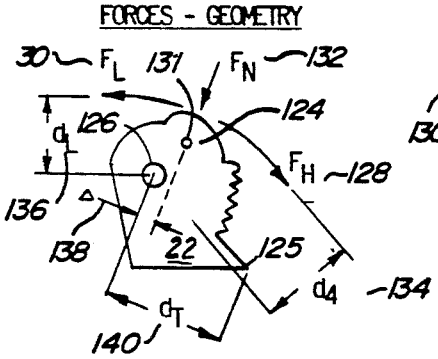
FIG. 12 is a plan view of the cam of this invention showing the various forces acting thereon.

As shown in FIG. 12, the movement of cord 80 over cam 22 causes several forces to act on the cam 22. The tension in cord 80 represented by equal and opposite forces "FH" and "FL" 128, 130 (i.e., the force from the operator's hand and from the individual strings 76, respectively), generates a net resultant vector force "Fn" or 132, which is directed through point 131 (i.e. the point of origin of the arc of surface 124). Additionally, a friction force (not shown) resulting from movement of the cord 80 upon surface 124 will act tangentially to such surface, and a force will act on tip 125 if the cord 80 is placed in contact therewith.

The cam 22 will pivot within device 20 in response to the various rotational moments caused by the friction force, the force 128, 130 acting along the arrows shown, and by the rotational moment caused by contact of cord 80 with tip 125. The moment, for a particular force, is defined by the multiplication of the amplitude or strength of the force and the moment arm or distance of the force vector from the point 126. The greater the moment, the greater the tendency of cam 22 to pivot in response to that force. As seen, in FIG. 12, force 128 is applied to surface 124 at a distance 134 (from point 126), force 130 is applied to surface 124 at a distance 136 (from point 126), while force 132 is applied to surface 124 at a distance 138 (from point 126). Additionally, the distance from tip 125 to point 126 is defined as distance 140.

Figure 13:
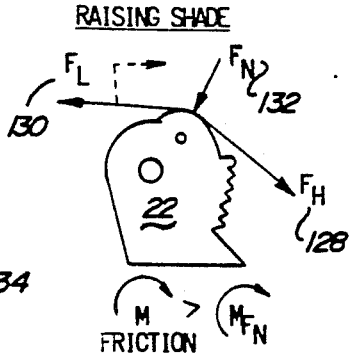
FIG. 13 is a plan view of the cam of this invention showing the various forces and moment arms acting thereon during controlled raising of a typical shade.

Referring now to FIG. 13, during the controlled raising of shade 12, the cord 80 is pulled away from tip 125 and down over surface 124. During the controlled raising of the shade 12, the moment caused by the force 132 and the friction force are both in a clockwise direction and act to rotate serrations 120 away from fixed clamping member 114, thereby allowing cord 80 to pass freely therebetween. In this "open position" the movement of cam 22 is limited by its contact with tab 102.

Figure 14:
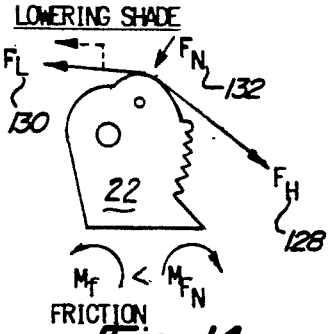
FIG 14 is a plan view of the cam of this invention showing the various forces and moment arms forces acting thereon during a controlled descent of a typical shade.

During the controlled descent of the shade 12, as shown in FIG. 14, the cord 80 is pulled away from tip 125 and up over surface 124. During this controlled lowering, the moment caused by force 132 is in a clockwise direction and is greater than the counterclockwise moment caused by the friction force. Cam 22 is therefore pivoted in a clockwise manner out of clamping engagement with serrations 120 while tip 125 is kept away from cord 80. The cord 80 therefore freely passes over surface 124. It should be noted that during the controlled lowering of shade 12, cord 80 may be in contact with tooth 122 (though not in position to contact tip 125). With cord 80 contacting both surface 124 and tooth 122, the tension-induced resultant force on tooth 122 will act clockwise about center of rotation 126 to thereby prevent undesired clamping. Therefore, tooth 122 prevents the moment of rotation of this friction force from becoming greater than the moment of rotation of force 132, thereby preventing unwanted clamping during the controlled descent of shade 12.

Figure 18:
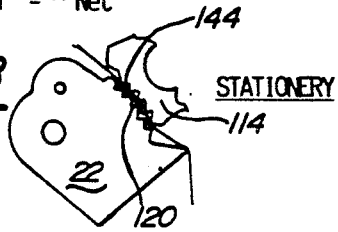
FIG. 18 is a plan view of the cam of this invention showing the various forces and moment arms acting thereon when the cord is released during either the raising or the lowering of the shade.

If the cord 80 should be released during a controlled descent of the shade 12, thereby resulting in a "free-fall" condition, the rotational moment forces shown in FIG. 18 would result. That is, although forces 128 and 130 tend toward zero, a friction force resulting from the drag of cord 80 along surface 124 will tend to rotate cam 22 in a counter-clockwise direction. The counter-clockwise friction force causes tip 125 to contact cord 80 and causes cord 80 to be statically contained between serrations 120 and 144 of member 114. The tension in cord 80 (i.e., resulting from the weight of the shade, and represented by force 130) will tend to keep the cam 22 in this closed position until a shade operator desires to change the shade position.

Figure 15:
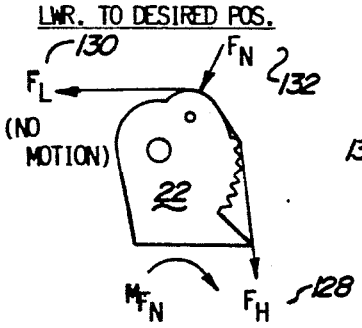
FIG. 15 is a plan view of the cam of this invention showing the various forces and moment arms acting thereon once the shade is lowered to a desired position.
Figure 16:
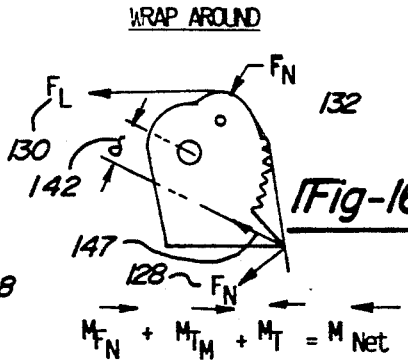
FIG 16 is a plan view of the cam of this invention showing the various forces and moment arms acting thereon during the locking of the shade.

As shown in FIG. 15, once cord 80 has been lowered to a desired position and all needed cord motion ceases, the rotational moment associated with force 132 will still impart a clockwise or opening force on cam 22 due to the continued tension in the still unreleased cord 80. Therefore, to cause the cam 22 to close, a wraparound is needed. That is, after the shade 12 has been lowered to a desired position, cord 80 is partially wrapped around tip 125 in the manner shown in FIG. 16. During this wraparound a resultant counter-clockwise moment of rotation results which causes cam 22 to close. This resultant moment results from a combination of the friction force imparted to tip 125 by cord 80 and the large distance 146. Concomitantly, the resultant tip force 147 is acting through a relatively small moment arm 142 and therefore produces a relatively small moment of rotation.

Figure 17:
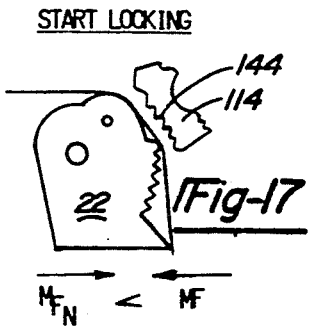
FIG. 17 is a plan view of the cam of this invention showing the various forces and moment arms acting thereon during the static clamping of the shade.

As shown in FIG. 17, static locking will start once wraparound has been completed. During locking, tip 125 remains in contact with cord 80 while cord 80 produces a frictional force created by opposed teeth 120 and 144, resulting in a counter-clockwise moment of rotation. This moment is greater than the moment produced by force 132 (which is now primarily composed of force 130). Therefore, once locked, cam 22 will have a tendency to remain locked. In this closed position, the movement of cam 22 is limited by the opposed teeth 120 and 144.

After device 20 has been inserted into head rail 14, top cap 24 is placed over device 20 and is also inserted into the head rail 14. Specifically, as shown in FIGS. 1 and 8, cap 24 includes a planar body 146 having tabs 148 which slide into rail 14 and are frictionally gripped between opposite interior sides of the head rail 14. This engagement of tabs 148 couples the cap 24 within the head rail 14 such that planar body 146 overlies device 20. Clips 116 (FIG. 8) co-operatively engage corresponding clips (not shown) provided by top cap 24 and this co-operative engagement prevents the cap 24 from being easily removed from device 20.

Body 146 also provides openings 150, 152 which respectively receive posts 82 and 84, and also provides a post 156 which is received by member 114. The respective reception of posts 82, 84, and 156 by openings 150, 152 and by member 114 further couples cap 24 to device 20 and prevents posts 82 and 84 from deforming in response to the various forces imparted to cam 22.

Body 146 also provides raised pockets 158, 160, and 162. When the cap 20 is inserted into head rail 14, pocket 158 having substantially the same shape as depression 86 is made to overlay depression 86 while pocket 162 having substantially the same shape as depression 88 is made to overlay depression 88. Pocket 160 has a first portion which has substantially the same shape as depression 94 and a second portion which has substantially the same shape as depression 90. When cap 20 is inserted into rail 14, the first and second portions of pocket 160 respectively overlay depressions 94 and 96.

As will be understood, depending on whether cam 22 is assembled in a right hand or left hand application, pockets 158, 160, and 162 cooperate with appropriate tabs 90, 92, 98 and 100 to guide the cam 22 during its pivotal movement and to prevent cord 80 from becoming wedged or jammed above or below the cam 22. Additionally, top cap 20 co-operates with indentations 118 to brush and comb cord 80 as it traverses between the cap 20 and the portion 118 in order to prevent fraying or tangling of the cord 80 as it is repeatedly used to reposition shade 12. The remaining open end of rail 14, as shown in FIG. 2, may be closed by cap 26 in order to prevent dust or debris from entering rail 14 and damaging apparatus 20 or providing an unsightly appearance.

It is to be understood that the invention is not limited to the exact construction or method illustrated and described above, but that various changes and modifications may be made without departing from the spirit and the scope of the invention as described in the following claims.

We claim:

1. A cord locking apparatus for controlling a shade-positioning cord in a vertically adjustable shade which is suspended from a top shade rail comprising:

a cord lock body including first and second pivot post means each adapted to pivotably mount a cam lock member;

said body further including fixed lock member means symmetrically located in close proximity to each of said first and said second pivot posts, said fixed lock member means each including a first cord engaging surface;

a cam lock member having a second cord engaging surface which, when said cam lock member is mounted on either of said pivot post means, is shaped and positioned relative to said fixed lock member means to selectively permit the cord to freely pass therebetween for raising and lowering of the shade or to alternatively clamp said cord between said first and said second cord-engaging surfaces to maintain the shade at a desired height;

said body being adapted for selective assembly to whichever longitudinal end of the top shade rail it is desired to position and access the cord; and whereby the same body can be alternatively used at either end of the rail by mounting said cam lock member on the appropriate one of said first and said second pivot post means and threading the cord between said cam lock member and said fixed lock member.

2. The cord locking apparatus of claim 1, wherein said cam lock member has tab means projecting beyond the plane of pivotal moment of said second cord-engaging surface surfaces and projecting radially beyond said second cord-engaging surface, said tab means being received in cooperating depressions in said body to prevent the cord from leaving the space between said cam lock member and said fixed lock member.

3. The cord locking apparatus of claim 1, wherein said cam lock member has a cord-engaging surface comprising smooth first and second portions on opposite ends of said cord-gripping surface of said cam lock member, said first portion being generally arcuate and positioned so that a component of tension forces in the cord applied thereto always generates a moment of rotation tending to pivot said cord lock member in a cord releasing direction, said second portion being configured as a projecting tip positioned to be engaged by the cord and to generate a moment of rotation causing said cord lock member to pivot to a cord-locking position when the cord is completely released by a user and when the cord is manually guided to a pre-determined cord-locking position when the shade has reached a desired height.

4. The cord locking apparatus of claim 1, wherein the clamping of said cord between said first and said second cord-engaging surfaces takes place in a horizontal plane.

5. The cord locking apparatus of claim 1, wherein the initial movement of said cam lock member to clamp said cord between said first and said second cord-engaging surfaces occurs due to friction between said cord and said cam lock member, and continues because of the moment created about said pivot post.

6. The cord locking apparatus of claim 1, wherein said cam lock member and said pivot post means are positioned entirely within a longitudinal projection of said shade rail.

7. A cord locking apparatus for controlling a shade-positioning cord in a vertically adjustable shade which is suspended from a top shade rail comprising:

a cord lock body having a pivot post adapted to pivotably mount a cam lock member, said cam lock member having a cord engaging surface comprising smooth first and second portions, said first portion being generally arcuate and positioned so that a component of tension forces in the cord applied thereto always generates a moment of rotation tending to pivot said cord lock member in a cord releasing direction, said second portion being configured as a projecting tip positioned to be engaged by the cord and to generate a moment of rotation causing said cord lock member to pivot to a cord locking position when the cord is completely released by a user and when the cod is manually guided to a predetermined cord locking position when the shade has reached a desired height;

said body further including a fixed lock member means cooperating with said cam lock member so selectively permit the cord to pass freely therebetween, when said cam lock member is in said cord releasing position in order to allow for raising and lowering of the shade or to alternatively clamp said cord between cord-gripping surfaces thereon when said cam lock member is in said cord locking position thereby preventing said shade to be moved.

8. The cord locking apparatus of claim 7, wherein said cam lock member has tab means projecting beyond the plane of pivotal movement of said cord-gripping surfaces, said tab means being received in cooperating depressions in said body to prevent the cord from leaving the space between said cord lock member and said fixed lock member.

* * * * *